United States Patent [19]

Foissac et al.

[11] 4,437,288

[45] Mar. 20, 1984

[54] LATTICE-TYPE STRUCTURE, PARTICULARLY MAST SUPPORT OF ANTENNA

[75] Inventors: Yves Foissac; Frederic N. B. Hung, both of Saint Amand les Eaux, France

[73] Assignee: Laboratoire D'Etudes Et De Recherches Chimques L.E.R.C., France

[21] Appl. No.: 323,674

[22] Filed: Nov. 23, 1981

[30] Foreign Application Priority Data

Dec. 1, 1980 [FR] France ..... 80 25454

[51] Int. Cl.[3] ..... E04H 12/00

[52] U.S. Cl. ..... 52/637; 52/648; 52/695; 403/171; 403/218

[58] Field of Search ..... 52/655, 637, 638, 648, 52/650, 690, 695, 40; 403/171, 172, 176, 218; 46/29

[56] References Cited

U.S. PATENT DOCUMENTS

| | | | |
|---|---|---|---|
| 349,049 | 9/1886 | Lippincott | 52/638 |
| 490,267 | 1/1893 | Burnham | 52/655 |
| 637,420 | 11/1899 | Robbins | 52/655 |
| 824,501 | 6/1906 | Molloy | 52/648 |
| 1,162,294 | 11/1915 | Lichtenberger | 52/696 |
| 1,166,688 | 1/1916 | Hornby | 403/218 |
| 2,001,215 | 5/1935 | Rappel | 52/655 |
| 3,148,539 | 9/1964 | Cook | 52/648 |
| 3,195,938 | 7/1965 | Rifken | 403/218 |

FOREIGN PATENT DOCUMENTS

| | | | |
|---|---|---|---|
| 844813 | 5/1952 | Fed. Rep. of Germany | 52/638 |
| 2416243 | 10/1975 | Fed. Rep. of Germany | 52/648 |
| 545995 | 7/1956 | Italy | 49/29 |

*Primary Examiner*—Henry E. Raduazo
*Attorney, Agent, or Firm*—Jacobs & Jacobs

[57] ABSTRACT

Lattice-type structure, formed by uprights disposed like the parallel edges of a regular prism, and by windbracing panels connecting said uprights in two's via sleeves fitted and fixed on these respective uprights, said sleeves comprising at least one pair of projecting sockets for connecting the upright with two adjacent windbracing panel elements.

7 Claims, 4 Drawing Figures

FIG. 1
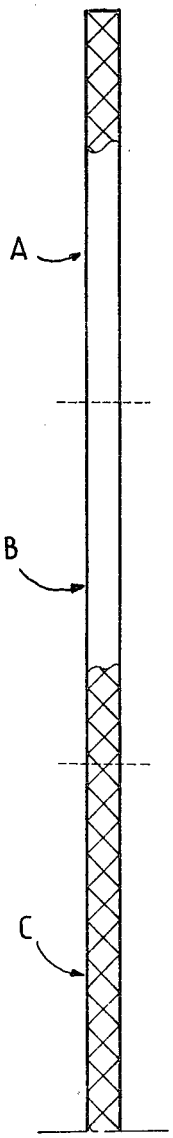
FIG. 2
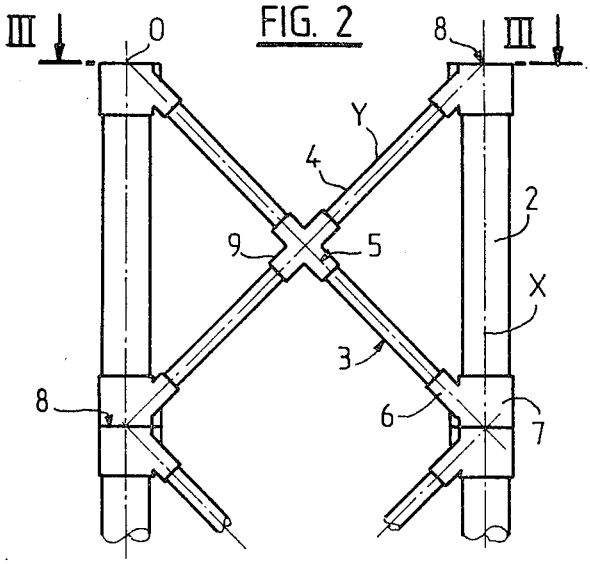
FIG. 3
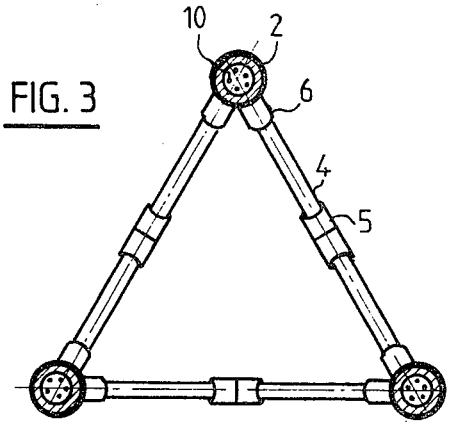
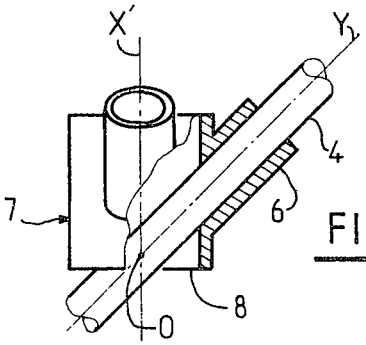
FIG. 4

LATTICE-TYPE STRUCTURE, PARTICULARLY MAST SUPPORT OF ANTENNA

The present invention relates to a lattice-type structure, advantageously made of reinforced resin, which may be used in particular as mast for supporting high-power antennas, several tens of meters tall.

The advantages of antenna masts made of reinforced resin over metallic masts are known. Reinforced resin is amagnetic and insulating and therefore creates no electromagnetic disturbance. Its low density facilitates transport and handling. Due to its resistance to corrosion, its life expectancy is very long.

However, when the device to be supported, for example an antenna mounted at the top of the mast, is very heavy, of the order of several tons, and when the mast must be several tens of meters high, the mechanical strength of the conventional reinforced resin masts, formed by cylindrical elements fitted end to end, is obviously insufficient.

It is an object of the invention to provide a lattice-type structure which may be used as mast and which, made of reinforced resin, has a mechanical strength comparable to that of metallic structures.

The structure according to the invention is characterised in that it is formed by frames or uprights which are advantageously cylindrical, disposed like the parallel edges of a regular prism, and by windbracing panels connecting said uprights in two's via sleeves fitted and fixed on the respective uprights, said sleeves comprising at least one pair of projecting sockets for connecting the upright with two adjacent panel elements.

The windbracing panels of the same section of the structure (or of the same level for a mast) are assembled together in advance via said sleeves to constitute a module, the continuous succession of the adjacent modules finally being traversed by the uprights and assembled therewith in appropriate manner.

In an advantageous embodiment, each panel is constituted by four crosspieces, in the form of cylindrical bars, assembled in the same plane by a spider comprising to this end four sockets forming a cross.

Moreover, the sockets of each sleeve open inside said sleeve; their axes converge with one another and with the axis of the sleeve. Finally, this sleeve is preferably limited, towards the adjacent module, by a plane perpendicular to its axis passing through the point of convergence of these axes.

Thus, the diameter of the sleeve being larger than that of the sockets, it is possible, for assembling the modules on a template, to engage each of the crosspieces in its socket, by passing through the sleeve, then to advance it up to the spider, this avoiding the difficulty of effecting the assembly of a panel by simultaneously engaging the two ends of the crosspieces in the sockets of the sleeves and of the spider, then by progressively reducing the dimensions of the geometrical figure thus produced.

In addition, when two sleeves belonging to two adjacent modules are joined, all the axes of the crosspieces belonging to these two sleeves converge at the same point on the axis of the upright, this point constituting an articulated junction of the lattice-type structure.

The structure (girder or mast) may be of any length, in one piece or formed by sections assembled by connection of the sections of uprights end to end; this assembly as well as the modes of use of the structures do not form part of the invention.

The invention will be more readily understood on reading the following description with reference to the accompanying drawings, in which:

FIG. 1 shows a structure according to the invention, in the present case an antenna mast formed by a plurality of sections.

FIG. 2 shows to a larger scale part of the structure, only one of the faces being shown.

FIG. 3 is a transverse section along plane III—III of FIG. 2.

FIG. 4 is a view in elevation of a sleeve adapted for a quadrangular structure.

Referring now to the drawings, FIG. 1 shows a mast 1 adapted to support at its top a device such as a radio transmitting or receiving antenna (not shown).

This mast is maintained in erected position, in known manner, by an assembly of guys (not shown).

The mast 1 is formed, in the example shown, by three identical structures A, B, C fixed end to end. Each structure may comprise three parallel uprights 2 disposed (FIG. 3) along the edges of a regular prism of triangular section.

The uprights 2 are connected in two's by windbracing panels 3 forming a cross. As shown in FIG. 2, this panel comprises four identical crosspieces 4 fixed by one end in the sockets 9 of a spider 5. The crosspieces 4 are engaged and fixed by their other end in the sockets 6 projecting from the sleeves 7, fitted and fixed on the uprights 2. In the present example, the sockets 6 are inclined at 45° with respect to the axis of the sleeve 7 to correspond to the angles of the arms of the spider 5.

In FIG. 3, three identical windbracing panels connect the three uprights 2 in a triangle; each angle sleeve element 7 comprises in this case two sockets 6 located in planes at 60° about the axis of the upright. As may be seen in FIG. 4, the sockets 6 fast with the same sleeve 7 open inside said sleeve, this enabling each crosspiece 4 to be engaged through the interior of the sleeve 7 in its socket 6 until it is guided into the corresponding socket 9 of the spider 5.

Moreover, the axes, X of the sleeve and Y of each of the sockets 6, converge at the same point 0 through which passes the plane 8 which limits each sleeve in the direction of the adjacent sleeve. In this way, the passage of the crosspiece 4 through the sleeve is clear; moreover, when the sleeves 7 belonging to modules are connected so that their planes 8 are merged, each point 0 becomes an articulated junction of the lattice structure.

In the embodiment according to FIG. 3, the assembly of the three panels of the same level and the associated sleeves constitutes a windbracing module, composed in the present case of six sleeves 7, three spiders 5 and twelve crosspieces 4.

For assembly, the windbracing modules are connected, the sleeves 7 belonging to successive modules having their end faces 8 in contact.

The uprights 2 are then engaged in the sleeves 7 of the modules and fixed therein in appropriate manner.

Uprights, crosspieces and sleeves may be made of any material provided that they are suitable for assembly by gluing, welding, keying, etc.

All these elements—uprights, crosspieces, spiders and sleeves—are preferably made of fibre-reinforced resin, which allows resistant assemblies by gluing.

The uprights and the crosspieces are tubes which may be obtained by "pultrusion", i.e. by extrusion combined with a traction exerted on the end of the tube during manufacture. In the case of antennas, they may be filled with a cellular material 10 forming electrical insulator, such as a polyurethane.

The spiders 5 and the sleeves 7 may be made of non-rigid thermoplastic material, containing glass fibres and injection moulded. Consequently, each of these elements may perform, in the structure, the role of an articulation in the sense of the theory of articulated lattices; the moments of fixing may be considered as negligible and, the junctions being punctual, the crosspieces and the free portions of the uprights are subjected to traction or compression.

When the structure is formed by sections, their assembly is necessarily effected on site, but it is prepared in the factory.

The sections, once assembled in the factory, are dismantled for transport, which therefore does not raise any problems.

The invention is applicable to masts, particularly for supporting antennas, to temporary or permanent structural frameworks and other applications where lightness and wide span are to be associated.

What is claimed is:

1. A lattice type structure, which comprises:

(a) a plurality of cylindrical, continuous uprights disposed in parallel like the parallel edges of a regular prism, and (b) a plurality of rigid reinforcing panels connecting in two's said uprights, (c) said panels comprising at least one pair of cylindrical sleeves having integral open socket means for holding reinforcing crosspieces, said sleeves having planar end faces with said uprights passing through said sleeves and said faces; the inner diameter of said sleeve being larger than the inner diameter of the socket means and the intersection of the axis of the socket means and the axis of said sleeve being at or near the intersection of one of said end faces with said sleeve axis, whereby reinforcing crosspieces may be inserted through said one end face, into said sleeve and thence into and through a said socket means; and reinforcing crosspieces engaged in said socket means for connecting said pair of sleeves together.

2. The structure of claim 1, wherein the uprights are cylindrical tubes.

3. The structure of claim 1, wherein the crosspieces are cylindrical rods.

4. The structure of claim 1, which comprises three uprights and, in section, is thus in the form of an equilateral triangle.

5. The structure of claim 1, made of synthetic material, wherein the uprights and the crosspieces are rigid tubes made of polymerisable resin, reinforced with longitudinal fibres, whilst the sleeves and the spiders, forming the junctions of the lattice-type structure, are made of moulded thermoplastic material of lesser rigidity.

6. The structure according to claim 1, wherein said panel comprises four sleeves, four crosspieces, and a flat spider having four sockets, each crosspiece having one end held by a socket means of one of said sleeves and the other end held in a socket of said spider.

7. The structure according to claim 1, wherein said end faces are perpendicular to said sleeve axis.

* * * * *